US007179780B2

(12) United States Patent
Forth et al.

(10) Patent No.: US 7,179,780 B2
(45) Date of Patent: Feb. 20, 2007

(54) DETERGENT PRODUCT

(75) Inventors: Peter Jens Forth, Brussels (BE); Etienne Marie Betty Andre Jeuniaux, Merchtem (BE); David William Ingram, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 74 days.

(21) Appl. No.: 10/095,786

(22) Filed: Mar. 12, 2002

(65) Prior Publication Data

US 2002/0169095 A1 Nov. 14, 2002

(30) Foreign Application Priority Data

Mar. 16, 2001 (GB) ..... 0106545.7

(51) Int. Cl.

| | |
|---|---|
| ***C11D 3/30*** | (2006.01) |
| ***C11D 3/37*** | (2006.01) |
| ***C11D 7/38*** | (2006.01) |
| ***C11D 1/00*** | (2006.01) |

(52) U.S. Cl. ..... 510/393; 510/205; 510/305; 510/392

(58) Field of Classification Search ..... 510/392, 510/393, 216, 277, 480, 533, 223, 229, 230, 510/318, 361, 398, 434, 476, 220, 305, 205; 252/90, 174.12

See application file for complete search history.

(56) References Cited

U.S. PATENT DOCUMENTS

| | | | | |
|---|---|---|---|---|
| 4,305,837 | A | | 12/1981 | Kaminsky et al. |
| 4,610,799 | A | | 9/1986 | Wilsberg et al. |
| 4,846,992 | A | | 7/1989 | Fonsny |
| 4,886,615 | A | | 12/1989 | Dehan |
| 4,929,380 | A | | 5/1990 | Schulz et al. |
| 4,973,410 | A | | 11/1990 | Pinschmidt, Jr. et al. |
| 5,281,355 | A | * | 1/1994 | Tsaur et al. ..... 510/393 |
| 5,395,616 | A | | 3/1995 | Edwards et al. |
| 5,516,449 | A | * | 5/1996 | Agar et al. ..... 510/301 |
| 5,741,767 | A | * | 4/1998 | Nicholson et al. ..... 510/220 |
| 5,783,546 | A | * | 7/1998 | Bettiol et al. ..... 510/305 |
| 5,877,141 | A | | 3/1999 | Gabriel et al. |
| 5,891,837 | A | * | 4/1999 | Baillely et al. ..... 510/309 |
| 6,037,319 | A | | 3/2000 | Dickler et al. |
| 6,165,970 | A | * | 12/2000 | Williams (nee Mac Beath) et al. ..... 510/480 |
| 6,287,585 | B1 | * | 9/2001 | Johansen ..... 424/405 |

FOREIGN PATENT DOCUMENTS

| | | |
|---|---|---|
| EP | 0 158 464 B1 | 10/1985 |
| EP | 0 234 867 B1 | 1/1992 |
| EP | 1 067 176 A1 | 1/2001 |
| WO | WO 94/04656 | 3/1994 |
| WO | WO 95/04806 | 2/1995 |

* cited by examiner

*Primary Examiner*—Douglas McGinity
*Assistant Examiner*—Preeti Kumar
(74) *Attorney, Agent, or Firm*—Armina E. Matthews; Kim William Zerby

(57) ABSTRACT

The present invention relates to an article comprising: (a) a liquid composition comprising: (i) enzyme; and (ii) from 0% to 10% (by weight of said liquid composition) free water, preferably 0% to 5% free water; and (iii) carboxylic acid comprising 5 carbon atoms or less, and 1 or 2 carboxy groups; and (iv) chelating agent; and (v) enzyme stabilizing metal ion system consisting of calcium ions and magnesium ions, present in a weight ratio of calcium ion to magnesium ion of from 1:1 to 4:1; and (vi) from 0% to 0.2% (by weight of said liquid composition) source of borate ions; and (b) a water-soluble polymeric material that is capable of being cross-linked by borate ions, preferably a water-soluble polymeric material comprising poly-vinyl alcohol.

16 Claims, No Drawings

DETERGENT PRODUCT

CROSS REFERENCE TO RELATED APPLICATIONS

This application claims priority under 35 U.S.C. § 119(a) to Great Britian Application Serial No. 0106545.7, filed Mar. 16, 2001 (Attorney Docket No. CM2516F).

TECHNICAL FIELD

The present invention relates to the field of detergent compositions, especially detergent compositions comprising enzymes.

BACKGROUND

Many consumers do not want to come into contact with detergent ingredients such as enzymes that are commonly used and found in liquid detergent products, during the washing process. The detergent industry has been trying to prevent or minimise the contact between detergent ingredients such as enzymes and the consumer. For example, the detergent industry minimised the contact between detergent ingredients and the consumer by enclosing, or at least partially enclosing said detergent ingredients with a laminate or film, to produce detergent pouches. Typically said laminate or film comprises water-soluble poly-vinyl alcohol (PVA).

In addition to minimising the contact between detergent ingredients and the consumer, consumers like the benefits of having unit dose detergent products, such as detergent pouches. Many consumers find unit dose detergent products easier and quicker to use during the washing process. For example, by using unit dose detergent products, the amount of detergent to be used during the washing process is already pre-selected for the consumer, negating the need for the consumer to determine, and measure, the desired amount of detergent product which can be a difficult and time consuming procedure.

Unit dose detergent products in the form of pouches are known. For example, EP158464, U.S. Pat. No. 4,846,992, U.S. Pat. No. 4,886,615, U.S. Pat. No. 4,929,380 and U.S. Pat. No. 6,037,319 relate to detergent pouches. Pouches containing liquid detergent compositions are also known. For example EP158464, EP234867, EP656054, U.S. Pat. No. 4,610,799, U.S. Pat. No. 4,846,992, U.S. Pat. No. 4,929,380, U.S. Pat. No. 4,973,410, U.S. Pat. No. 5,395,616, and U.S. Pat. No. 6,037,319 relate to pouches containing a liquid composition.

Films or laminates that are used to enclose, or partially enclose, liquid compositions typically comprise water-soluble PVA. Said films and laminates have the optimum water-dissolution and/or water-disintegration profiles, optimum mechanical strength, and aesthetic properties, that provide pouches which have adequate structural strength during storage and handling by the consumer, adequate aesthetic properties that the consumer likes, and adequate water-dissolution and/or water-disintegration properties when contacted to an aqueous environment such as a wash liquor.

Liquid detergent compositions which comprise enzymes, also typically comprise borate. Said borate acts to stabilise said enzymes in a liquid environment. However, borate and water-soluble PVA interact to form cross-linked PVA, said cross-linked PVA has different structural and chemical properties than water-soluble PVA. Thus, a film or laminate comprising water-soluble PVA, when contacted to borate ions, forms a film or laminate comprising cross-linked PVA, which has poor dissolution properties and poor aesthetic properties, which the consumer does not like, and which does not dissolve and/or disintegrate adequately during the washing process.

Therefore, liquid detergent compositions comprising enzymes, which are enclosed, or at least partially enclosed, by a film or laminate comprising water-soluble PVA to form a pouch, typically comprise low amounts of borate ions, or are free from borate ions, to overcome the problem of the PVA interacting with the borate ions and forming cross-linked PVA. Thus, said liquid detergent compositions have poor enzyme stability properties, which results in poor enzyme activity during the laundering process.

SUMMARY OF THE INVENTION

The inventors have surprisingly found that the problem of poor enzyme stability in liquid detergent compositions comprising low amounts of borate, or that are free of borate, can be overcome by providing an article comprising: (a) a liquid composition comprising: (i) enzyme; and (ii) from 0% to 10% (by weight of said liquid composition) free water; and (iii) carboxylic acid comprising 5 carbon atoms or less, and 1 or 2 carboxy groups; and (iv) chelating agent; and (v) enzyme stabilizing metal ion system consisting of calcium ions and magnesium ions, present in a weight ratio of calcium ion to magnesium ion of from 1:1 to 4:1; and (vi) from 0% to 0.2% (by weight of said liquid composition) source of borate ions; and (b) a water-soluble polymeric material that is capable of being cross-linked by borate ions, preferably a water-soluble polymeric material comprising polyvinyl alcohol.

DETAILED DESCRIPTION

Article

The article of the invention (herein referred to as article) comprises: (a) a liquid composition comprising: (i) enzyme; and (ii) from 0% to 10% (by weight of said liquid composition) free water; and (iii) carboxylic acid comprising 5 carbon atoms or less, and 1 or 2 carboxy groups; and (iv) chelating agent; and (v) enzyme stabilizing metal ion system consisting of calcium ions and magnesium ions, present in a weight ratio of calcium ion to magnesium ion of from 1:1 to 4:1; and (vi) from 0% to 0.2% (by weight of said liquid composition) source of borate ions; and (b) a water-soluble polymeric material that is capable of being cross-linked by borate ions, preferably a water-soluble polymeric material comprising poly-vinyl alcohol. Said liquid composition, said enzyme, said carboxylic acid, said chelating agent, said calcium ions and magnesium ions, and said water-soluble polymeric material are described in more detail hereinafter.

The article can be of any form, shape and material which is suitable to hold the liquid composition, e.g. without allowing the release of the liquid composition from the article prior to contact of said article to water. The exact execution will depend on, for example, the type and amount of the composition in the article, the characteristics required from the article to hold, protect and deliver or release the liquid composition and/or components thereof. The article may be in the form of a: hexagonal shape; square shape; rectangular shape; or cylindrical shape. The article may be spheroid or spherical.

The article may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load. Typically, the width or diameter of the article is between 2 cm and 12 cm, preferably 2.5 cm or even 3 cm to 10 cm or even to 8 cm or even to 6 cm.

The article is typically made from a water-soluble polymeric material, preferably said water-soluble polymeric material encloses an inner volume space. Said inner volume space of the article is preferably enclosed by a water-soluble material in such a manner that said inner volume space is separated from the outside environment. The liquid composition, or components thereof, are typically contained in the inner volume space of the article, and are typically separated from the outside environment by a barrier of water-soluble polymeric material. The term "separated" means for the purpose of this invention "physically distinct, in that a first ingredient contained within the inner volume space of the article herein, is prevented from contacting a second ingredient if said second ingredient is not contained within said inner volume space". The term "outside environment" means for the purpose of this invention "anything which is not contained within the inner volume space of the article herein, and is not part of the article thereof".

The inner volume space of the article herein is suitable to hold a liquid composition, e.g. without allowing the release of the liquid composition or component thereof, from the article prior to contact of the article to water. The inner volume space can have any form or shape, depending on the nature of the material of the article, the nature of the liquid composition or component thereof, and the intended use and amount of the article, liquid composition, or component thereof.

The article itself is preferably water-soluble and/or water-dispersible, and typically has a water-solubility and/or water-dispersibility of at least 50%, preferably at least 75% or even at least 95%, as measured by the method set out hereinafter using a glass-filter with a maximum pore size of 20 microns, namely: Gravimetric method for determining water-dispersibility and water-solubility of the article herein: 50 grams±0.1 gram of the article is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with a maximum pore size of from 20 micrometers to 50 micrometers. The water is dried off from the collected filtrate by any conventional method, and the weight of the remaining material is determined (which is the dissolved or dispersed fraction). Then, the % water-solubility or water-dispersability can be calculated.

Preferably said article is a pouch. Most preferably, said article is a water-soluble pouch. If the article is in the form of a pouch, the pouch may contain one compartment, or may contain more then one compartment. If the article is in the form of a multi-compartment pouch, then different compartments of the pouch may contain different components or parts of the liquid composition. However, if different components of the liquid composition are contained in different compartments of a multi-compartment pouch, it is highly preferred that the enzyme, carboxylic acid, chelating agent and enzyme stabilizing metal ion system are contained in the same compartment to stabilise the enzyme during storage of the multi-compartment pouch.

Water-soluble Polymeric Material

The water-soluble polymeric material typically has a water-solubility and/or water-dispersibility of at least 50%, preferably at least 75% or even at least 95%, as measured by the method set out hereinbefore for determining the a water-solubility and/or water-dispersibility of the article herein.

Preferred water-soluble polymeric materials are formed into a film, laminate or sheet. The water-soluble polymeric material can, for example, be obtained by casting, blow-moulding, extrusion or blow extrusion of the water-soluble polymeric material, as known in the art.

Typically said water-soluble polymeric material comprises at least one polymer, copolymer or derivative thereof, suitable for use in the article herein. Preferably said polymer, copolymer or derivative thereof is selected from polyvinyl alcohol (PVA), polyvinyl pyrrolidone, polyalkylene oxide, acrylamide, acrylic acid, cellulose, cellulose ether, cellulose ester, cellulose amide, polyvinyl acetate, polycarboxylic acid and salt thereof, polyaminoacid or peptide, polyamide, polyacrylamide, copolymer of maleic/acrylic acids, polysaccharide including starch and gelatine, natural gum such as xanthum and carragum. More preferably said polymer, copolymer or derivative thereof is selected from polyacrylate and water-soluble acrylate copolymer, methylcellulose, carboxymethylcellulose sodium, dextrin, ethylcellulose, hydroxyethyl cellulose, hydroxypropyl methylcellulose, maltodextrin, polymethacrylate. Most preferably said polymer, copolymer or derivative thereof is selected from PVA, PVA copolymer and hydroxypropyl methyl cellulose (HPMC), and combinations thereof.

Mixtures of polymers, co-polymers, derivatives thereof, or combinations thereof, can also be comprised by the water-soluble polymeric material. This may in particular be beneficial to control the mechanical and/or dissolution properties of the water-soluble polymeric material and/or the article itself, depending on the application thereof and the required needs. For example, it may be preferred that a mixture of polymers is comprised by the water-soluble polymeric material, whereby one polymer has a higher water-solubility than another polymer, and/or one polymer has a higher mechanical strength than another polymer. It may be preferred that a mixture of polymers, co-polymers, derivatives thereof, or combinations thereof, is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful is a water-soluble polymeric material comprising a polymer blend, for example comprising a hydrolytically degradable and water-soluble polymer blend, such as a polylactide and PVA blend, usually achieved by the mixing of the polylactide and PVA, typically comprising (by weight of the polymer blend) from 1% to 35% polylactide and from 65% to 99% by weight PVA.

The polymer, co-polymer or derivative thereof can have any weight average molecular weight, preferably from about 1000 to 1,000,000, or even form 10,000 to 300,000 or even form 15,000 to 200,000 or even form 20,000 to 150,000. It may be preferred that the polymer, co-polymer, or derivative thereof is from 60% to 98% hydrolysed, preferably from 80% to 90% hydrolysed, to improve the dissolution of the water-soluble polymeric material.

Preferably, the level of polymer in the water-soluble polymeric material is at least 60%. The water-soluble polymeric material may comprise other additive ingredients other than a polymer. For example, it may be beneficial to add plasticisers, for example glycerol, ethylene glycol, diethyleneglycol, propylene glycol, sorbitol and mixtures thereof, additional water, disintegrating aids. It may be useful when the liquid composition contained within the article herein is a liquid detergent composition or component thereof, that the water-soluble polymeric material itself comprises a detergent additive to be delivered to the wash water, for example organic polymeric soil release agents, dispersants, dye transfer inhibitors, or combinations thereof.

Most preferred water-soluble polymeric materials are films or laminates which comprise PVA, especially preferred are water-soluble polymeric materials that comprise PVA and have similar properties to the film which comprises PVA and is known under the trade reference M8630, as sold by Chris-Craft Industrial Products of Gary, Ind., US. Other preferred water-soluble polymeric materials suitable for use herein have similar properties to films that comprise PVA and are known under the trade reference PT film or the K-series of films supplied by Aicello, or VF-HP film supplied by Kuraray.

Liquid Composition

The liquid composition comprises: (i) enzyme; (ii) from 0% to 10% (by weight of said liquid composition) free water; (iii) carboxylic acid comprising 5 carbon atoms or less, and 1 or 2 carboxy groups; (iv) chelating agent; (v) enzyme stabilizing metal ion system consisting of calcium ions and magnesium ions, present in a weight ratio of calcium ion to magnesium ion of from 1:1 to 4:1; and (vi) from 0% to 0.2% (by weight of said liquid composition) source of borate ions.

Preferred liquid compositions are cleaning compositions, pharmaceutical compositions, agrochemical compositions, dyeing compositions, fabric treatment compositions. Cleaning compositions are typically useful in hand and automatic laundry and dish washing, hard-surface cleaning, and personal cleaning, preferred cleaning compositions are laundry detergent compositions. Preferred fabric treatment compositions are fabric conditioning compositions, fabric softening compositions and fabric enhancing compositions.

The liquid composition typically comprises (by weight of the liquid composition) less than 0.2% source of borate ions, more typically less than 0. 1%, or less than 0.05%, or less than 0.01% or less than 0.001% source of borate ions. Preferably, the liquid composition is substantially free from a source of borate ions. Preferably, the liquid composition comprises no deliberately added sources of perborate. The source of borate ions is typically any compound that is capable of releasing a borate ion, especially in an aqueous environment. Typically sources of borate ions are compounds having similar properties to perborate, a preferred source of borate ions is perborate.

The liquid composition typically has a viscosity of from 1 Pa.s to 500 Pa.s, as measured at a shear rate of 1.7 $s^{-1}$ at a temperature of 25° C.

The liquid composition, or component thereof, is preferably contained in the article herein such that it is not released from the article until said article is contacted to water. Preferably, the liquid composition, or component thereof, is enclosed, or partially enclosed by the water-soluble polymeric material. Preferably, the liquid composition is contained within a pouch made of the water-soluble polymeric material. Thus, in the above preferred embodiment of the present invention, the article is in the form of a pouch.

Enzyme

The enzyme is comprised by the liquid composition. The liquid composition preferably comprises (by weight of liquid composition) from 0.0001% to 5% enzyme, preferably from 0.001%, or from 0.01%, or from 0.1% enzyme, and preferably to 4%, or to 3%, or to 2% enzyme.

The enzyme may be of any suitable origin, such as vegetable, animal, bacterial, fungal and yeast origin. The origin can further be mesophilic or extremophilic (psychrophilic, psychrotrophic, thermophilic, barophilic, alkalophilic, acidophilic, or halophilic). Purified or non-purified forms of the enzyme may be used. The enzyme may also be a mutant of a native enzyme. Mutants can be obtained any method known in the art: typically by protein and/or genetic engineering, chemical and/or physical modification. Common practice as well is the expression of the enzyme via host organisms in which the genetic material responsible for the production of the enzyme has been cloned: such as by any suitable recombinant DNA techniques known in the art.

The enzyme is preferably selected from the group consisting of cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and combinations thereof. More preferably, the enzyme is selected from the group consisting of proteases, amylases, lipases, peroxidases, and combinations thereof. Most preferably, the enzyme is an amylase and/or protease. If the enzyme is a combination of protease and amylase, then preferably the weight ratio of protease to amylase is from 1:10 to 10:1, preferably from 1:1 to 8:1, preferably from 2:1 to 6:1, most preferably from 3:1 to 5:1.

Suitable amylases for use herein are α-amylases and/or β-amylases. Preferred amylases are stability-enhanced amylases supplied by Genencor, and amylase variants supplied by Novo Nordisk A/S. Preferred α-amylases are: Purafect Ox Am® from Genencor; and Termamyl®, Ban®, Fungamyl® and Duramyl®, and Natalase®, which are available from Novo Nordisk A/S, Denmark. Also suitable for use herein are variants of the above amylases. Another preferred amylase is Maxamyl® supplied by Gist-Brocades.

Suitable proteases for use herein are the subtilisins which are obtained from particular strains of *B. subtilis* and *B. licheniformis*. One suitable protease is obtained from a strain of *Bacillus* and sold as ESPERASE® by Novo Industries A/S of Denmark. Other suitable proteases include: ALCALASE®, DURAZYM® and SAVINASE® from Novo; and MAXATASE®, MAXACAL®, PROPERASE® and MAXAPEM® (protein engineered Maxacal) from Gist-Brocades. Other suitable proteases are: bacterial serine proteases; alkaline serine proteases; carbonyl hydrolases; protease BLAP®; high pH proteases; recombinant trypsin-like proteases; variants thereof; and combinations thereof.

Carboxylic Acid

The carboxylic acid comprises 5 carbon atoms or less, and 1 or 2 carboxy groups. Preferably the carboxylic acid contains 1 carboxy group. The term "carboxylic acid" includes derivatives of carboxylic acids including anions of carboxylic acids, salts of carboxylic acids, a complex of a carboxylic acid with another compound, and combinations thereof. The carboxylic acids suitable for use herein are mono-carboxylic acids and di-carboxylic acids.

The liquid composition preferably comprises (by weight of the liquid composition) from 0.1% to 10% carboxylic acid, preferably from 0.2%, or from 0.3%, or from 0.4%, or from 0.5%, or from 0.6%,m or from 0.7%, or from 0.8% carboxylic acid, and preferably to 8%, or to 6%, or to 4%, or to 2%, or to 1.8%, or to 1.6%, or to 1.4%, or to 1.2% carboxylic acid.

Typical carboxylic acids suitable for use herein have the general formula:

R—(COOH)n;

wherein: R is a substituted or unsubstituted $C_1$–$C_5$ alk(en)yl, preferably $C_1$–$C_4$ alk(en)yl, or preferably a $C_1$–$C_3$ alky(en)yl; and n=1.

Preferred carboxylic acids suitable for use herein are methanoic acid, ethanoic acid, propanoic acid, derivatives thereof, and combinations thereof.

Chelating Agent

By chelating agent, it is meant agents that sequester or chelate heavy metal ions. Chelating agents suitable for use herein may have calcium and magnesium chelation capacity, but preferentially they show selectivity to binding heavy metal ions such as iron, manganese, copper, and zinc.

The liquid composition preferably comprises (by weight of the liquid composition) from 0.01% to 25% chelating agent, preferably from 0.2%, or from 0.4%, or from 0.6%, or from 0.8% chelating agent, and preferably to 20%, or to 15%, or to 10%, or to 5%, or to 3%, or to 2% chelating agent.

Preferably the weight ratio of chelating agent to carboxylic acid present in the liquid composition is from 10:1 to 1:10, preferably from 5:1, or from 2:1, and preferably to 1:5, or to 1:2. Preferably the weight ratio of chelating agent to enzyme metal stabilizing ion system is from 20:1 to 1:10, preferably from 15:1, or from 10:1, or from 5:1, and preferably to 1:5, or to 1:3, or to 1:1. Preferably, the weight ratio of chelating agent to enzyme metal stabilizing ion system is at least 1:1.

Preferred chelating agents are acidic compounds, typically having phosphonic acid and/or carboxylic acid functionality. These chelating agents may be present either in their acid form, or as a complex/salt with a suitable counter cation such as an alkali metal ion, alkaline metal ion, ammonium or substituted ammonium ion, derivatives thereof, or combinations thereof. Preferably, chelating agents in the form of a salt/complex are water-soluble.

Suitable chelating agents for use herein are organic phosphonates, such as the amino alkylene poly (alkylene phosphonates), alkali metal ethane 1-hydroxy disphosphonates and nitrilo trimethylene phosphonates. Preferred chelating agents are: diethylene triamine penta (methylene phosphonic acid) (DTPMP); ethylene diamine tetra(methylene phosphonic acid) (DDTMP); hexamethylene diamine tetra(methylene phosphonic acid); hydroxy-ethylene 1,1 diphosphonic acid (HEDP); hydroxyethane dimethylene phosphonic acid; ethylene di-amine di-succinic acid (EDDS); ethylene diamine tetraacetic acid (EDTA); diethylene triamine pentaacetic acid (DTPA); derivatives thereof; salts thereof; and combinations thereof. Preferred chelating agents are: DTPMP; DDTMP; DTPA; EDDS; derivatives thereof; salts thereof; and combinations thereof. Most preferred chelating agents are: DTPMP; DDTMP; derivatives thereof; salts thereof; and combinations thereof.

Enzyme Stabilizing Metal Ion System

The enzyme stabilizing metal ion system consists of calcium ions and magnesium ions present in a weight ratio of calcium ions to magnesium ions of from 8:1 to 1:8. Preferably the weight ratio of calcium ions to magnesium ions is from 6:1, or from 4:1, and preferably to 1:6, or to 1:4, or to 1:2, or to 1:1. Preferably the weight ratio of calcium ions to magnesium ions is at least 1:1.

The liquid composition preferably comprises (by weight of the liquid composition) from 0.001% to 1% enzyme stabilizing metal ion system, preferably from 0.005%, or from 0.01% enzyme stabilizing metal ion system, and preferably to 0.8%, or to 0.6%, or to 0.4% enzyme stabilizing metal ion system.

Preferably the weight ratio of enzyme to enzyme stabilizing metal ion system is from 200:1 to 1:1, preferably from 150:1, or from 100:1, or from 75:1, and preferably to 5:1, or to 10:1, or to 15:1, or to 20:1, or to 25:1, or to 30:1, or to 35:1, or to 40:1. Preferably the weight ratio of enzyme to enzyme stabilizing metal ion system is at least 1:1, preferably at least 10:1, or at least 20:1, or at least 30:1, or at least 40:1, or at least 50:1.

Process for Making the Article

The article is typically made by enclosing, or partially enclosing the liquid composition, or part thereof, with the polymeric water-soluble material, or part thereof. Typically, the water-soluble polymeric material, preferably in the form of a film and/or laminate, is positioned in a mould and an indent formed in the water-soluble polymeric material by moving said material such that it is flush with the inner surface of the mould: this can be done by a thermo-forming process or a vacuum forming process.

Thermo-forming typically involves the step of forming an open article or pouch in a mould under application of heat, which allows the material used for the article or pouch to take on the shape of the mould. Vacuum-forming typically involves the step of applying a (partial) vacuum (reduced pressure) on a mould which sucks the material into the mould and ensures the material adopts the shape of the mould. The article forming (or pouch forming) process may also be done by first heating the material and then applying reduced pressure: for example by a partial-vacuum process.

The indent formed in the water-soluble polymeric material is then typically filled with the liquid composition, or component thereof, and the indent is closed and sealed. Typically the indent is closed with a second piece of water-soluble polymeric material, alternatively, the same piece of water-soluble polymeric material may be positioned such that the indent formed can be closed using the same piece of said material that was used to form said indent, for example by folding said piece of material. The sealing can be done by any known method, for example by heat sealing, pressure sealing, ultrasonic sealing, wetting, use of gluing agent, compression, or combinations thereof. The seal can extend from the article or pouch, forming a skirt around the article or pouch. Alternatively, it may be preferred that the seal does not extend from the article or pouch, in this preferred embodiment of the present invention, the skirt, if present on the article after the sealing process, is cut-off completely.

Optional Ingredients of the Article

Preferably, the liquid composition is a cleaning composition and typically comprises a member selected from the group consisting of: surfactant; builder; perfume; buffer; filler agent; performance enhancing polymers such as anti-redisposiition polymers and/or soil dispersing polymers and/or soil releasing polymers and/or fabric integrity polymers and/or dye-transfer inhibition polymers; anti-foam compounds; thickening agents; fabric softening agents; flocculants; and combinations thereof. The liquid composition may comprise bleaching agents.

Preferred surfactants are: nonionic surfactants; anionic surfactants; cationic surfactants; zwitterionic surfactants; amphoteric surfactants; derivatives thereof; and combinations thereof. Preferably the liquid composition comprises (by weight of the liquid composition) from 10% to 60% surfactant, preferably from 20%, or from 25%, or from 30% surfactant, and preferably to 55%, or to 50%, or to 45% surfactant. If the surfactant comprises nonionic surfactant and anionic surfactant, then preferably the weight ratio of nonionic surfactant to anionic surfactant is from 10:1 to 1:10, preferably from 5:1, or from 2:1, and preferably to 1:5, or to 1:2.

Preferred nonionic surfactants are the condensation products of aliphatic alcohols with from 1 to 12, preferably from 3 to 7, moles of ethylene oxide and/or propylene oxide per compound. The alkyl chain of the aliphatic alcohol can either be straight or branched, primary or secondary, and generally contains from 6 to 22 carbon atoms. Other preferred nonionic surfactants include: polyhydroxy fatty acid amides such as $C_{12}$–$C_{18}$ alkyl N-methyl glucamide; fatty acid amide surfactants and/or alkoxylated fatty acid amides; alkyl esters of fatty acids; alkylpolysaccharides; derivatives thereof; and combinations thereof. Preferred anionic surfactants include: linear or branched primary and secondary alkyl sulphates; alkyl ethoxysulphates; fatty oleoyl glycerol sulphates; alkyl phenol ethylene oxide ether sulphates; the $C_5$–$C_{17}$ acyl-N—($C_1$–$C_4$ alkyl) and —N—($C_1$–$C_2$ hydroxyalkyl) glucamine sulphates; and sulphates of alkylpolysaccharides such as the sulphates of alkylpolyglucoside; $C_5$–$C_{20}$ linear or branched alkylbenzene sulphonates; alkyl ester sulphonates, in particular methyl ester sulphonates; $C_6$–$C_{22}$ primary or secondary alkane sulphonates; $C_6$–$C_{24}$ olefin sulphonates; sulphonated polycarboxylic acids; alkyl glycerol sulphonates; fatty acyl glycerol sulphonates; fatty oleyl glycerol sulphonates; alkyl ethoxy carboxylates; alkyl polyethoxy polycarboxylates; soaps made of alkyl carboxyls; alkali metal sarcosinates such as myristyl and oleoyl methyl sarcosinates; salts thereof; derivatives thereof; combinations thereof.

Preferred cationic surfactants include: cationic esters, cationic mono-alkoxylated amines, cationic bis-alkoxylated amines, derivatives thereof; and combinations thereof.

Preferred zwitterionic surfactants include: derivatives of secondary and tertiary amines; derivatives of heterocyclic secondary and tertiary amines; derivatives of quaternary ammonium, quaternary phosphonium or tertiary sulfonium compounds; and combinations thereof. Especially preferred zwitterionic surfactants are betaine and sultaine surfactants.

Suitable amphoteric surfactants for use herein include: amine oxides; alkyl amphocarboxylic acids; derivatives thereof; and combinations thereof.

The liquid composition preferably comprises a solvent. Preferred solvents do not dissolve or damage the water-soluble polymeric material of the article. More preferably, the solvent is a long chain, low polarity solvent. By long chain it is meant solvents comprising molecules having a carbon chain of greater than 6 carbon atoms, and by low polarity it is meant a solvent having a dielectric constant of less than 40. Preferred solvents include $C_{12-14}$ paraffin and more preferably $C_{12-14}$ iso-paraffin. Other solvents include alcohols such as: methanol; ethanol; propanol;, iso-propanol; derivatives thereof; and combinations thereof. Other solvents suitable for use herein include diols. Other solvents suitable for use herein include: glycerol; di-propylene glycol; butyl alcohol; butoxy-propoxy propanol; paraffin oil; 2 amino-2 methyl propanol; derivatives thereof; and combinations thereof.

Preferred builders suitable for use herein are water-soluble builders such as alkali or earth alkali metal salts of phosphoric acid, such as: alkali metal tripolyphosphates; sodium, potassium and/or ammonium pyrophosphate; sodium and/or potassium orthophosphate; sodium polymeta/phosphate in which the degree of polymerisation ranges from about 6 to 21; and salts of phytic acid; derivatives thereof; and combinations thereof. Other preferred builders suitable for use herein are water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The article may comprise a bleach. If the article comprises a bleach, then preferably the bleach is contained separately from the enzyme and enzyme stabilizing compounds of the article. For example, the article may be in the form of a multi-compartment pouch, wherein a first compartment of said pouch contains a liquid composition or part thereof which comprises the enzyme, enzyme stabilizing heavy metal ion system, carboxylic acid and chelating agent, and wherein a second compartment of said pouch contains the bleach or a component of the liquid composition which comprises the bleach. In this preferred embodiment of the present invention wherein the article comprises a bleach which is contained separately from the enzyme, the enzyme activity of said article or liquid composition is stabilised. The bleach ingredient may be in the form of a solid, liquid, if the bleaching ingredient is in the form of a solid, then said bleach may be in the form of a suspended particle.

Preferred bleach ingredients include: oxidative bleaching ingredients such as hypochlorite, hydrogen peroxide; and reductive bleach ingredients such as sulphur dioxide. Most preferred are oxidative bleaching ingredients. Preferred bleaching ingredients include: sources of peroxide such as perborate monohydrate, perborate tetrahydrate, and percarbonate; sources of peracid such as tetraacetyl ethylene diamine (TAED); preformed peracids such as nonyl amido peroxy adipic acid (NAPAA) and N,N-pthaloylamino peroxycaproic acid (PAP); diacyl peroxides; bleach activators such as nonanoyl oxy benzene sulphonate (NOBS), (6-nonamidocaproyl) oxybenzene sulfonate (NAC-OBS); caprolactam bleach activators such as acyl caprolactam, 6-(N,N,N-trimethylammonio)hexanoyl caprolactam tosylate salt, benzoyl caprolactam; bleach catalysts; bleach boosters such as aryliminium zwitterions, and arylinium polyions having a net charge of from −1 to −3; derivatives thereof, salts thereof; and combinations thereof. Preferred bleaching ingredients are PAP, NOBS, TAED, and combinations thereof.

The liquid composition may comprise a suds suppressor. Preferred suds suppressors include: soap; paraffin; wax; silicone compounds; derivatives thereof; and combinations thereof.

The liquid composition may comprise a thickening agent. Preferred thickening agents suitable for use herein include: tertiary amine oxides comprising a $C_{8-22}$ alkyl chain or tertiary alkyl amine oxides comprising two or more $C_{1-5}$ alkyl chains; hydrophobically modified synthetic polymers typically having a molecular weight of at least 200 kDa derived from monomers of acrylic acid, maleic acid, asparic acid, and/or vinyl ester, such as polymers with similar properties to the polymer known under the trade name as Acusol; gums selected from the group consisting of karaya gum, tragacanth gum, guar gum, locust bean gum, alginates, carragean, xanthan gum, and combinations thereof; starches;

carboxy methyl celluloses or derivatives thereof such as hydroxyethyl cellulose (HEC), hydrophobically modified HEC, hydroxypropyl cellulose, hydroxypropylmethyl cellulose, hydroxybutylmethyl cellulose, and combinations thereof; polyethylene glycols having a molecular weight of at least 100 kDa; clays selected from the group consisting of smectite clay, hectorite clay, bentonite clay or a combination thereof; derivatives thereof; and combinations thereof.

EXAMPLES

| Ingredients | A | B | C | D | E |
|---|---|---|---|---|---|
| Linear $C_{11}$–$C_{13}$ alkyl benzene sulphonic acid | 21 | 20 | 18 | 22 | 20 |
| $C_8$–$C_{10}$ amido propyl dimethyl amine | 1.8 | 2 | 1.5 | 1.7 | 1.6 |
| $C_{12}$–$C_{14}$ predominantly linear primary alcohol condensed with an average of 5–9 moles of ethylene oxide | 18 | 15 | 20 | 17 | 16 |
| citric acid | 1.5 | 1.7 | 1.5 | 1 | 2 |
| $C_{12}$–$C_{18}$ topped whole cut fatty acids | 16 | 17 | 18 | 15 | 16 |
| Protease | 1 | 1.2 | 0.8 | 1 | 1.1 |
| Amylase | 0.2 | 0.3 | 0.3 | 0.2 | 0.4 |
| Mannanase | 0.1 | 0.05 | 0.1 | 0.07 | 0.2 |
| Ethanoic acid | 1 | 1.5 | 0.5 | 1.1 | 0.8 |
| Magnesium chloride | 0.1 | 0.07 | 0.12 | 0.09 | 0.15 |
| Calcium chloride | 0.2 | 0.22 | 0.2 | 0.19 | 0.18 |
| Ethoxylated tetraethylene pentaimine | 1.5 | 1.7 | 1.6 | 2 | 1.6 |
| Ethoxylated polyethyleneimine | 1.5 | 1.7 | 1.6 | 1.8 | 1.6 |
| Diethylene triamine penta(methylene phosphonate) | 0.8 | 0.9 | 0.8 | 1 | 0.6 |
| Flourescent whitening agent | 0.3 | 0.2 | 0.4 | 0.1 | 0.2 |
| 1,2 propanediol | 15 | 18 | 15 | 12 | 16 |
| Monoethanolamine | 11 | 10 | 12 | 14 | 10 |
| Perfume | 1.5 | 2 | 1.7 | 1.6 | 1.8 |
| Dye | 0.0006 | 0.0014 | 0.0013 | 0.0015 | 0.0012 |
| Miscellaneous | to 100% | to 100% | to 100% | to 100% | to 100% |

The above liquid detergent compositions A to E were enclosed in a film of polyvinyl alcohol to form detergent pouches.

What is claimed is:

1. An article comprising a liquid composition enclosed by a water-soluble polymeric material comprising polyvinyl alcohol that is capable of being cross-linked by borate ions wherein:

a) the liquid composition comprises:

i) an enzyme;

ii) from 0% to 10%, by weight of said liquid composition, of free water;

iii) from 0.1% to 10% by weight of said liquid composition, of a carboxylic acid selected from the group consisting of methanoic acid, ethanoic acid, propanoic acid, derivatives thereof and combinations thereof;

iv) a chelating agent;

v) an enzyme stabilizing metal ion system consisting of calcium ions and magnesium ions, present in a weight ratio of calcium ion to magnesium ion of from 1:1 to 4:1;

said composition comprising less than 0.01% by weight of a source of borate ions and wherein said article is a water-soluble pouch.

2. An article according to claim 1, whereby said water-soluble material is in the form of a film, a laminate, or mixture thereof.

3. An article according to claim 1, whereby said enzyme is an amylase, protease, or mixture thereof.

4. An article according to claim 1, whereby said chelating agent is diethylene triamine penta (methylene phosphonic acid), ethylene diamine tetra(methylene phosphonic acid), or mixture thereof.

5. An article according to claim 1, whereby said liquid composition is a detergent composition.

6. An article according to claim 1 wherein the water-soluble polymeric material comprises at least one polymer, copolymer, or derivative thereof selected from the group consisting of polyvinyl pyrrolidone, polyalkylene oxide, acrylamide, acrylic acid, cellulose, cellulose ether, cellulose ester, cellulose amide, polyvinyl acetate, polycarboxylic acids, polycarboxylic acid salts, polyaminoacids, peptides, polyamides, polyacrylamides, copolymer of maleic/acrylic acids, polysaccharides, natural gums, and mixtures thereof.

7. An article according to claim 1 wherein the water-soluble polymeric material consists of polyvinyl alcohol.

8. An article according to claim 1 wherein the liquid composition comprises from 0.0001% to 5%, by weight of the liquid composition, of the enzyme.

9. An article according to claim 1 wherein the enzyme is selected from the group consisting of proteases, amylases, lipases, peroxidases, and combinations thereof.

10. An article according to claim 1 wherein the liquid composition comprises from 0.01% to 25%, by weight of the liquid composition of chelating agent.

11. An article according to claim 1 wherein the liquid composition comprises from 0.001% to 1%, by weight of the liquid composition, of the enzyme stabilizing metal ion system.

12. An article according to claim 1 wherein the article has a water solubility of at least 50%.

13. An article according to claim 1 comprising a liquid detergent composition enclosed by a water-soluble film comprising poly-vinyl alcohol wherein:

a) the liquid composition comprises:

i) from 0.0001% to 5%, by weight of the liquid composition of said enzyme;

ii) from 0% to 5%, by weight of the liquid composition, of said free water;

iii) from 0.2% to 8%, by weight of the liquid composition, of said carboxylic acid;

iv) from 0.01% to 25%, by weight of the liquid composition, of said chelating agent;

v) from 0.001% to 1%, by weight of the liquid composition, of said enzyme stabilizing metal ion system;

said composition comprising less than 0.01% by weight of a source of borate ions and wherein said article is a water-soluble pouch.

14. An article according to claim 1, wherein said liquid composition is a laundry detergent composition.

15. An article according to claim 1, wherein said liquid composition comprises 0% borate ion source.

16. An article according to claim 13, wherein said liquid composition comprises 0% borate ion source.

* * * * *